US005370095A

United States Patent [19]

Yamaguchi et al.

[11] Patent Number: 5,370,095

[45] Date of Patent: Dec. 6, 1994

[54] FUEL-INJECTION DEVICE

[75] Inventors: Toshio Yamaguchi; Atsushi Ueda, both of Higashimatsuyama, Japan

[73] Assignee: Zexel Corporation, Tokyo, Japan

[21] Appl. No.: 94,890

[22] Filed: Jul. 22, 1993

[30] Foreign Application Priority Data

Jul. 23, 1992 [JP] Japan ..... 4-217312
Jul. 23, 1992 [JP] Japan ..... 4-217313

[51] Int. Cl.[5] ..... F02M 37/04; F02M 47/02

[52] U.S. Cl. ..... 123/446; 251/129.07; 239/88; 123/506

[58] Field of Search ..... 123/446, 447, 500, 501, 123/467, 506; 251/129.18, 129.07; 239/88-91, 95, 585.1, 585.3; 137/312

[56] References Cited

U.S. PATENT DOCUMENTS

| | | | |
|---|---|---|---|
| 4,408,718 | 10/1983 | Wich | 239/88 |
| 4,463,900 | 8/1984 | Wich | 239/88 |
| 4,470,545 | 9/1984 | Deckard et al. | 239/88 |
| 4,509,693 | 4/1985 | Nakai | 123/129.18 |
| 4,531,672 | 7/1985 | Smith | 123/446 |
| 4,618,095 | 10/1986 | Spoolstra | 239/95 |
| 4,905,960 | 3/1990 | Barnhart et al. | 123/129.18 |
| 4,941,612 | 7/1990 | Li | 239/88 |
| 5,082,180 | 1/1992 | Kubo et al. | 251/129.07 |
| 5,197,507 | 3/1993 | Miki et al. | 123/129.18 |
| 5,217,047 | 6/1993 | McCabe | 123/129.18 |
| 5,239,968 | 8/1993 | Rodriguez-Amaya et al. | 123/506 |
| 5,259,351 | 11/1993 | Rossignol | 123/447 |
| 5,265,804 | 11/1993 | Brunel | 123/506 |
| 5,277,163 | 1/1994 | Ohishi | 123/506 |

FOREIGN PATENT DOCUMENTS

| | | |
|---|---|---|
| 0309797 | 4/1989 | European Pat. Off. . |
| 0372562 | 6/1990 | European Pat. Off. . |
| 63-156460 | 10/1988 | Japan . |
| 2-35965 | 3/1990 | Japan . |
| 2133479 | 7/1984 | United Kingdom . |

*Primary Examiner*—E. Rollins Cross
*Assistant Examiner*—Thomas N. Moulis
*Attorney, Agent, or Firm*—Wenderoth, Lind & Ponack

[57] ABSTRACT

A solenoid valve is installed between a high-pressure side leading to a compressor of a fuel-injection pump and a low-pressure side to adjust the fluidic connection therebetween. This valve comprises a valve body, an armature, a solenoid which moves the armature, and a return spring. In the solenoid valve, a passage connecting an armature chamber and a balance chamber is formed around the edge of the opposite side of the armature, a rising-pressure preventing passage is provided to prevent an increase in pressure in the armature chamber, and compensation mechanism is provided in the junction area between the different members which accommodate the valve body, to thereby absorb a gap or misalignment between the sliding holes of the different members.

10 Claims, 6 Drawing Sheets

FUEL-INJECTION DEVICE

BACKGROUND OF THE INVENTION

1. Field of the Invention

This invention pertains to an injection control device for a fuel injection pump of a diesel engine, and more specifically, to a device that controls an injection level by use of a solenoid valve installed between the high-pressure side and the low-pressure side of the pump.

2. Description of the Related Art

It is well known that there is a conventional injection control device wherein a solenoid valve is installed between the high-pressure side leading to the compressor and the low-pressure side leading to the fuel-intake in the fuel injection pump, and in which the high-pressure side and the low-pressure side are connected while fuel-intake is in progress to introduce the fuel into the compressor from the low-pressure side, whereas the connection between the high-pressure side and the low-pressure side is cut off while compression is in progress, to inject the fuel from the compressor.

This type of injection control device, whose further development is now being worked on by the applicant, has a system wherein a valve body of the solenoid valve and an armature coacting with the valve body are connected; a spill chamber for allowing the high-pressure fuel to leak is formed around the valve head; an armature chamber for accommodating the armature is formed around the armature; and inside or around the valve body, a passage connecting the spill chamber and the armature chamber is formed, maintaining the pressure balance between the spill chamber and the armature chamber.

In the aforementioned technology, however, because the fuel spilled from the high-pressure side has very high pressure as high as 1500 kg/cm$_2$, periodic high-pressure surges in spike form are transferred from the spill chamber to the armature chamber via the aforementioned connection passage, by the fuel momentarily leaked to the low-pressure side when the solenoid valve has been opened, circulating around the armature, and colliding with the solenoid surface. After some period of time, this may possibly cause corrosion or deformation of a resin material covering the stator or coil, as shown in FIG. 6.

The valve body constituting the solenoid valve is constructed of different members at the front and the rear of the valve seat, which are inserted into the valve housing, and a sliding unit (i.e. opposed sliding surfaces) is formed in the area where the insertion is made. Although there is some clearance in each sliding unit (i.e. between sliding surfaces), there are cases when the centers of the holes in which the valves slide do not necessarily agree (i.e. the holes may be misaligned), at the front and the rear of the valve seat, since the valve body moves in only the axial direction. This may be due to an error in selecting the size of each constituent member of the solenoid valve, or an error in assembling these members. If, in this case, the gap between the hole centers (i.e. the amount of misalignment) is within (or less than) the amount of the clearance between sliding surfaces, there will be no problem. But, if the gap exceeds the amount of clearance, this can possibly prevent the smooth movement of the valve body.

To solve this problem, it can be considered that accuracy in assembling the valve constituent members should be improved to limit the gap between the hole centers within the amount of clearance, but this will require some means to assure accuracy in assembling and additional procedures.

SUMMARY OF THE INVENTION

Therefore, the present invention aims to offer a fuel injection device, wherein the transfer of high periodic pressure surges from a spill chamber to an armature chamber is prevented, while providing a connection passage for maintaining the pressure balance to provide smooth movement of the valve body. Thereby, corrosion or deformation of the solenoid, which can happen after some passage of time, can be reduced.

Briefly speaking, an objective of the present invention is to offer a fuel-injection pump, wherein between the high-pressure side leading to the compressor and the low-pressure side, a solenoid valve is installed, to adjust the connection condition between the high-pressure side and the low-pressure side. This solenoid valve comprises a valve body which includes a valve head which, together with its valve seat, are disposed in a spill chamber connected to the aforementioned low-pressure side, and which is equipped with sliding units (i.e. has sliding surfaces) to the front and rear of the valve head. An armature is connected to one end of the valve body and is accommodated in the armature chamber. A solenoid is provided to move the aforementioned armature so as to move the aforementioned valve body into a closed position while the compression is in progress in the fuel injection pump. A return spring is provided to push the aforementioned valve body against the electromagnetic force of the solenoid. In the aforementioned solenoid valve, a passage connects the aforementioned armature chamber and a balance chamber formed at an end of the valve body opposite the armature, and a rising-pressure preventing passage is provided to prevent an increase in pressure in the aforementioned armature chamber.

This rising-pressure preventing passage for preventing the pressure increase in the armature chamber may be formed by adjusting the clearance of the sliding unit, or by making the clearance of the sliding unit between the valve head and the balance chamber larger than the clearance of the sliding unit between the valve head and the armature. Alternatively, the rising-pressure preventing passage may be constructed so that the excessive high-pressure fuel that tries to leak via the sliding unit can leak, via a release passage, from the sliding unit between the valve head and the armature, to the spill chamber.

Since an equal amount of the fuel flows, via the connection passage, to the armature side and to the balance chamber, the valve can be moved smoothly by the electromagnetic force of the solenoid and the rebounding force of the return spring. In other words, while the fuel-intake is in progress and electrical conduction is not taking place, the valve head remains apart from the valve seat by the force of the return spring, and the low-pressure fuel goes into the high-pressure side from the low-pressure side, to be supplied to the compressor of the fuel injection pump. While the fuel compression is in progress and the electrical conduction is taking place, the armature is pulled by the electromagnetic force of the solenoid, and the valve head is seated in the valve seat, by which the fuel in the compressor is compressed. At the end of injection, when the high-pressure fuel is returned from the high-pressure side to the low-pressure side, the connection passage is not connected directly to the spill chamber, but is connected, via the clearance of the sliding unit, to the spill chamber, and therefore the periodic high-pressure surge is not transferred to the armature chamber.

In the aforementioned arrangement, the clearance of the sliding unit of the valve positioned between the valve head and the armature is ordinarily set small to keep the leakage of the high-pressure fuel to the armature chamber to a minimal level during the compression, but there is an apprehension that however small the clearance may be, the high-pressure fuel may leak via the gap to the armature chamber, causing the pressure in the armature chamber to gradually rise to an abnormally high level. Therefore, the pressure increase in the armature chamber is prevented by means of the rising-pressure preventing passage in this construction.

If the ring-pressure preventing passage is constituted so as to make the clearance of the sliding unit between the valve head and the balance chamber larger than the clearance of the sliding unit between the valve head and the armature, the pressure is released, via the connection passage and the balance chamber, from the clearance of the sliding unit between the valve head and the balance chamber, to the spill chamber, even when the high-pressure fuel is leaked to the armature chamber, and therefore the pressure in the armature chamber will constantly be low.

Furthermore, if the rising-pressure preventing passage comprises a return passage that returns the excessive high-pressure fuel to the spill chamber from the sliding unit between the valve head and the armature, the excessive fuel that tries to leak from the high-pressure side to the armature chamber, through the clearance of the sliding unit between the valve head and the armature, goes into the return passage prior to reaching the armature chamber, and is returned to the low-pressure side, and therefore the pressure in the armature chamber will constantly be kept low.

Another objective of the present invention is to provide the fuel injection pump with a solenoid valve positioned between the high-pressure side leading to the compressor and the low pressure side, to adjust the connection condition between both sides. The solenoid valve comprises a valve which is slidably inserted as different members to the front and the rear of the valve seat, an armature secured to the valve body, a solenoid which attracts the aforementioned solenoid during the period of electrical conduction, and a return spring which pushes the aforementioned valve body against the electromagnetic force of the solenoid. A play (or compensation) mechanism (i.e. a gap) is provided, in the area where the aforementioned different members for the valve to slide in are facing each other, to absorb the gap (misalignment) between the sliding holes of the aforementioned different members.

The play mechanism may be composed by constituting the valve body of two valve body members, and by connecting the two members so as to be radially movable relative to one another, in the area where the two different members, in which the valve body slides, are facing each other, so that the axial center of the valve body can be shifted in position. Alternatively, the play mechanism may be composed so that members in which the valve body is slidably inserted, can be moved radially relative to each other.

Accordingly, in the past, there was an apprehension that due to an assembling error made in assembling the members, in which the solenoid valve's valve body slide, the center line of the sliding hole could be misaligned. But, according to this invention, smooth movement of the valve body can be ensured without improving assembly precision, since the gap (or misalignment) between the sliding holes, in which the valve slides, is absorbed by the play mechanism. Therefore, the aforementioned objectives can be realized.

PREFERRED EMBODIMENT OF THE INVENTION

Preferred embodiments of the present invention are explained below with reference with the figures.

Figure 1:
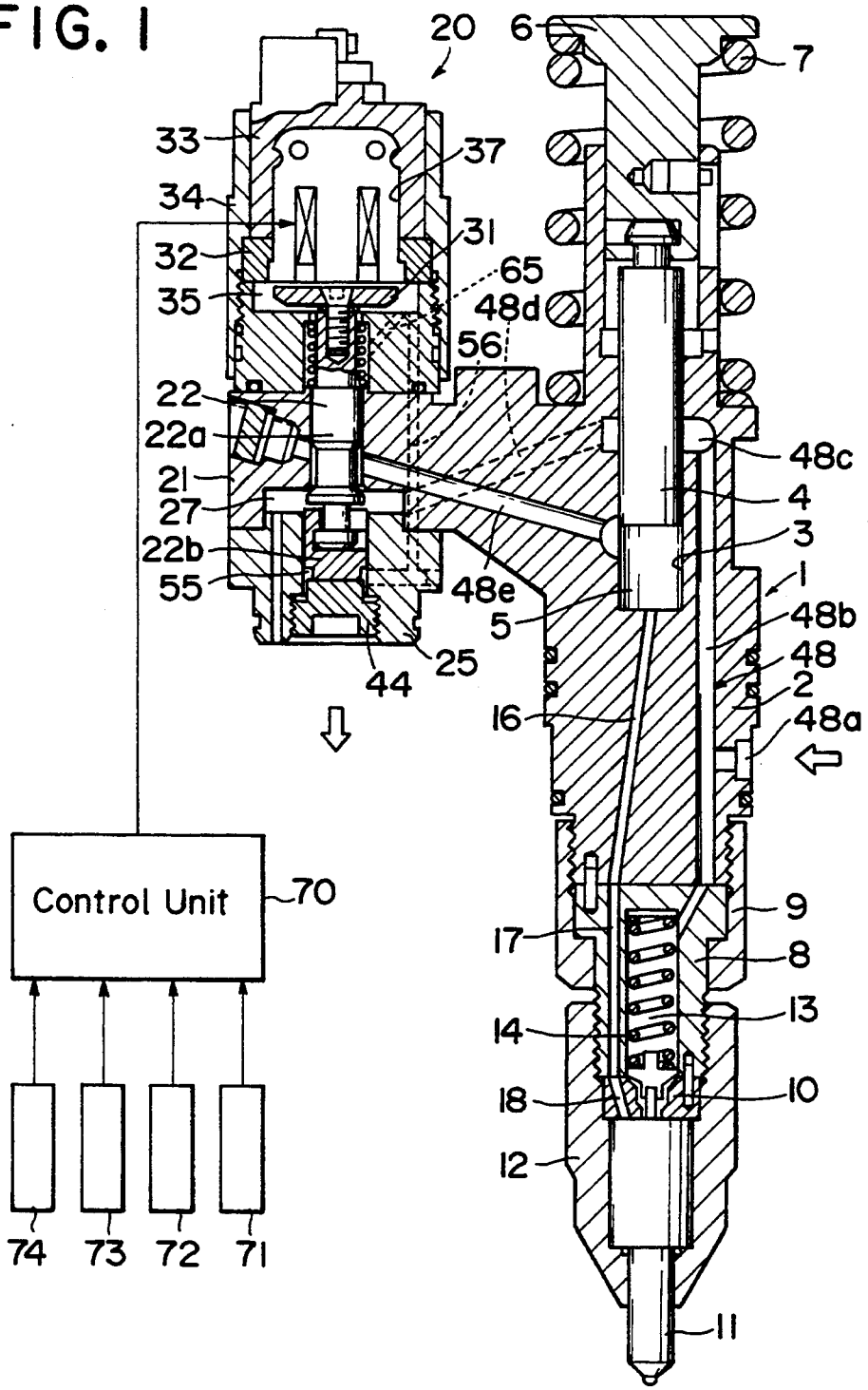
FIG. 1 shows a schematic diagram of a preferred embodiment of a fuel-injection device according to the present invention.

FIG. 1 shows that the fuel-injection device has a unit-injector type injection pump 1 which, for example, injects fuel into every cylinder of a diesel engine. In this injection pump 1, a plunger 4 is slidably inserted in a cylinder 3 formed in the base of a plunger barrel 2, and a compressor 5 is formed by the plunger barrel 2 and the plunger 4. The aforementioned plunger 4 is constantly pushed away from plunger barrel 2 (i.e. in the upward direction in FIG. 1) by spring 7 lying between a tappet 6 connected to plunger 4 and plunger barrel 2. Tappet 6 contacts with a cam formed on the driving shaft of an engine (not shown), and when the driving shaft rotates, tappet 6 coacts with the aforementioned spring 7 to reciprocate plunger 4.

To the end of plunger barrel 2, holder unit 8 is secured with a holder nut 9, and to this holder unit 8, a nozzle 11 is connected by a retaining nut 12 via spacer 10. On this holder unit 8, a spring case 13 is formed, and by a nozzle spring 14 accommodated in this spring case 13, a needle valve of the nozzle (not shown in the figure) is pressed in a downward direction in FIG. 1. The structure of nozzle 11 is well-known, and when a high-pressure fuel having a pressure higher than a specific level is supplied from compressor 5 located at the end of the plunger to nozzle 11 via a connection hole 16 formed in the plunger barrel, a connection hole 17 formed in holder unit 8, and a connection hole 18 formed in spacer 10, the needle valve is opened to inject the fuel from the injection hole formed in the tip of the nozzle.

Figure 2:
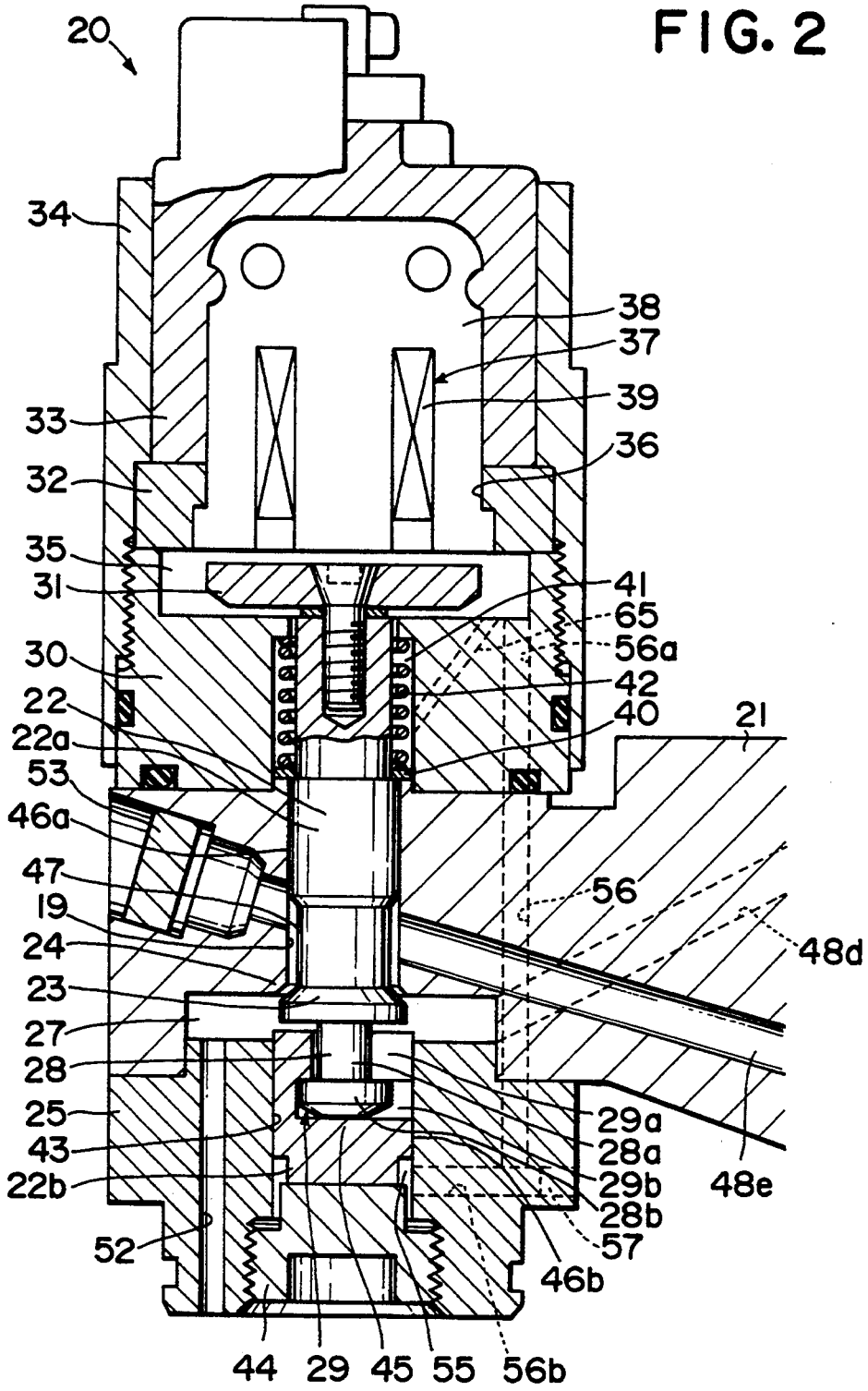
FIG. 2 shows an expanded sectional view of a solenoid valve of the fuel-injection device of FIG. 1.

Fuel supply to compressor 5 is adjusted by a solenoid valve 20. As shown in FIG. 2, this solenoid valve 20 is constructed as follows: a valve body 22 is slidably inserted in a sliding hole 19 of a valve housing 21 installed on plunger barrel 2; a valve seat 24 which is contacted by a valve head 23 integral with the valve body 22 is formed on valve housing 21; a spill chamber 27 accommodating valve head 23 is formed between valve seat 24 and a header 25 secured, with a screw, to valve housing 21 so as to cover valve head 23.

The valve body 22 comprises a first valve body member 22*a*, on which valve head 23 is formed and a second valve body member 22*b* connected to this first valve body member 22*a*. More specifically, first valve body member 22*a* has a connecting (or joining) piece 28 extending from valve head 23 to the header side, and this connecting piece 28 comprises a smaller diameter unit 28*a* extending from the valve head 23 and a larger diameter unit 28*b* integrally formed on the head of the smaller diameter unit 28*a*. On the other hand, second valve body member 22*b* has a joining cavity 29 formed at its side. In this joining cavity 29, a deep cavity 29*b*, in which the larger diameter unit 28*b* is inserted, is formed continuous to a shallow cavity 29*a* in which the smaller diameter unit 28*a* is disposed. The larger diameter unit 28*b* of joining piece 28 is engaged in the deep cavity 29*b* to allow for radial play, while the smaller diameter unit 28*a* of joining cavity piece 28 is inserted in shallow cavity 29*a* to allow for radial play.

The first valve body ember 22*a* extends through a holder 30 which is screwed to valve housing 21 on a side thereof opposite the header 25 and an armature 31 is screwed in the end of member 22*a*. To this holder 30, a solenoid accommodating barrel 33 is attached with a holder nut 34 via a spacer 32. The aforementioned armature 31 is accommodated in an armature chamber 35 formed between holder 30 and spacer 32, and faces solenoid 37 which is accommodated in solenoid barrel 33 via attaching hole 36 of spacer 32. This solenoid 37 is constituted by a coil 39 accommodated in a stator 38, and the end surface of stator 38 matches with that of spacer 32. In the aforementioned holder 30, a spring case 41 is formed between holder 30 and a spring receptacle 40 formed on the side of valve body 22, and in this spring case 41, a return spring 42, which constantly pushes valve head 23 away from valve seat 24, is accommodated. Therefore, only when electricity is conducted to solenoid 37, armature 31 is attracted to stator 38 against return spring 42, and valve head 23 is seated in valve seat 24.

Second valve body member 22*b* is slidably inserted in an insertion hole 43 formed in header 25. Insertion hole 43 of header 25 is closed tightly by adjusting plug 44 from outside, and this adjusting plug 44 constitutes a stopper 45, so the maximum opening level of solenoid valve 20 can be regulated by adjusting the adjusting plug 44.

In the valve body, in the front and the rear of valve head 23, in other words, in the area where first valve body member 22*a* contacts with valve housing 21, and in the area where second valve body member 22*b* contacts with header 25, sliding units 46*a*, 46*b* are provided, and the play mechanism is provided by providing a radial gap between first valve body member 22*a* and second valve body 22*b* to allow for play.

A loop-shaped (or annular) channel 47 with a slightly smaller diameter is formed in the valve body 22 on the return spring side of the valve head 23, and this loop-shaped channel 47 functions as a connecting groove to guide the fuel from one side to the other side between the high-pressure side and the low-pressure side when valve head 23 is apart from valve seat 24.

A fuel supply passage 48 comprises a fuel-intake 48*a* made in plunger barrel 2; an intake passage 48*b* opening into a loop-shaped groove 48*c* formed at a location such that its one end constantly faces the side surface of the plunger of the cylinder 3; a fuel-supply passage 48*d* which opens, at its one end, into the loop-shaped (or annular) groove 48*c* and is connected to spill chamber 27 at its other end; and a fuel-supply passage 48*e* which is, at its one end, connected to the aforementioned loop-shaped channel 47 and opens into the aforementioned compressor 5 at its other end. In the aforementioned solenoid valve 37, passages 48*b* and 48*d* are located on the low-pressure side leading to fuel intake 48*a*, and passage 48*e* is located on the high-pressure side leading to compressor 5.

The fuel flowing in from fuel-intake 48*a* is supplied from the low-pressure side to the high-pressure side, and is guided to compressor 5, when the plunger 4 is moving upward during the fuel-intake. Then, the fuel is compressed in the compressor, and is injected from nozzle 11, once the valve head 23 is seated in valve seat 24, when the plunger 4 moves down during the compression. When valve head 23 moves away from valve seat 24 during the compression, the fuel on the high-pressure side leaks back to the low-pressure side via loop-shaped channel 47, and the injection is completed.

The fuel outlet passage 52 is made in header 25, and this is connected to an overflow valve, not shown in the figure, to return the excessive low-pressure fuel to a fuel tank. A blind plug 53 plugs fuel supply passage 48*e* on the high-pressure side.

Moreover, a balance chamber 55 is formed in the area surrounded by the aforementioned header 25, second valve body member 22*b* and adjusting plug 44. Balance chamber 55 and armature chamber 35 are connected by a connection passage 56. In this example of the present invention, connection passage 56 comprises a vertical through-hole 56*a* running through armature chamber 35, holder 30, valve housing 21, and header 25; a horizontal through-hole 56*b* running through the side surface of the header 25 and balance chamber 55, and connected, at some point along the way, to the end of the vertical through-hole. The end opening of horizontal through-hole 56*b* is closed with a blind plug 57 at the side surface of header 25. By the presence of connecting passage 56, an equal level of pressure is exerted on both ends of valve 22; thereby, the smooth movement of valve 22 is ensured, and at the same time, damage to the solenoid valve 37 which can be caused by the impact of pressure waves is prevented, because even when the high-pressure fuel is returned to the low-pressure side, spill chamber 27 and armature chamber 35 are not directly connected, and the high-frequency pressure waves are not transferred to armature chamber 35.

The clearance of sliding unit 46*a* between spill chamber 27 and armature chamber 35 is set smaller than that of sliding unit 46*b* between spill chamber 27 and balance chamber 55. This minimizes fuel leakage from the high-pressure side to armature chamber 35 via the clearance of sliding unit 46*a*, and at the same time, fuel flow through the clearance of sliding unit 46*b* between spill chamber 27 and balance chamber 55, in spite of its high flow resistance, since a pressure-rise prevention passage is formed by the space of sliding unit 46*b*.

However small the clearance of sliding unit 46*a* may be set, the leakage of the excessive high-pressure fuel from the high-pressure side to armature 35 is unavoidable during the compression, when the solenoid valve seat 23 is seated in valve seat 23, and solenoid valve 20 is closed. Therefore, the pressure in the armature chamber gradually tries to rise, but since the clearance of sliding unit 46*b* is set larger than that of sliding unit 46*a*, the pressure escapes from balance chamber 55 connected to armature chamber 35 via the connecting passage, to spill chamber 27, and the pressure does not rise in armature chamber 35.

Electrical conduction to the aforementioned solenoid 37 is controlled by a control unit 70, which comprises an A/D converter, a multiplexer, a microcomputer, a memory, and a driving circuit. Inputs to the control unit 70 include signals from a rotation detector 71 detecting the rotation condition of the engine, an acceleration level detector 72 detecting the degree at which the accelerator is depressed (acceleration level), a reference pulse generator 73 attached to a driving shaft and generating pulses for each turn of the shaft past the reference angle position, and a needle valve lift sensor 74 sensing the needle's lift timing. Based on these signals, the starting time and the ending time of conduction are computed, and the electrical conduction to solenoid valve 37 continues for the necessary time period, so that the time length which the solenoid valve 20 is closed is controlled.

In the aforementioned arrangement, since the electrical conduction to solenoid valve 35 is not taking place while the fuel injection pump's fuel intake is not in progress, armature 31 is moved away from stator 38 by the return spring 42, and simultaneously the valve head 23 is separated from valve seat 24, by which the low-pressure fuel introduced to the low-pressure side is introduced to the high-pressure side via loop-shaped channel 47, and is supplied to compressor 5. During the compression, since the conduction to solenoid 37 continues, armature 31 is attracted to stator 38, and valve head 23 is seated in valve seat 24. By this, the communication between the low-pressure side and the high-pressure side is cut off, and the fuel in compressor 5 is compressed and injected from nozzle 11.

At the end of the compression period, the conduction to solenoid 37 is stopped, such that valve head 23 is separated from valve seat 24, the high-pressure fuel on the high-pressure side is returned to the low-pressure side via loop-shaped channel 47, and the pressure on the high-pressure side is drastically reduced, stopping the injection. When the high-pressure fuel is returned to the low-pressure side, the waves of periodic high-pressure surges try to be transferred to every place connected to spill chamber 27, as mentioned above, but since the spill chamber 27 and armature 35 are not directly connected, the periodic high-pressure surges are not transferred to armature chamber 35. In this case, it is conceivable that the pressure waves are transferred from spill chamber 27 to balance chamber 35 through the gap between spill chamber 27 and balance chamber 55, since this sliding gap is somewhat loosely formed, but the clearance of sliding unit **56*b* is small and has a high flow resistance, so it is highly unlikely that there would be any periodic high-pressure surges transferred to armature chamber 35**.

Because the periodic high-pressure surges, which go around armature 31 and reach the surface of solenoid 37, are eliminated, there is no impact on the resin covering the surface of stator 38 and coil 39. Therefore, the corrosion and deformation that can occur after some period of time can be prevented.

In the course of the compression when the valve seat 23 is seated in valve head 24, and solenoid valve 20 is closed, the leakage of the excessive high-pressure fuel from the high-pressure side to armature chamber 35 is unavoidable, however small the gap of sliding unit **46*a* may be. The pressure in the armature chamber gradually tries to rise, but since the clearance of sliding unit 46*b* (the pressure-rise prevention passage) is formed larger than that of sliding unit 56*a*, the pressure escapes to spill chamber 27 from balance chamber 55 connected to armature chamber 35 via connection passage 56, thereby preventing the increase in pressure in armature chamber 35**.

Figure 3:
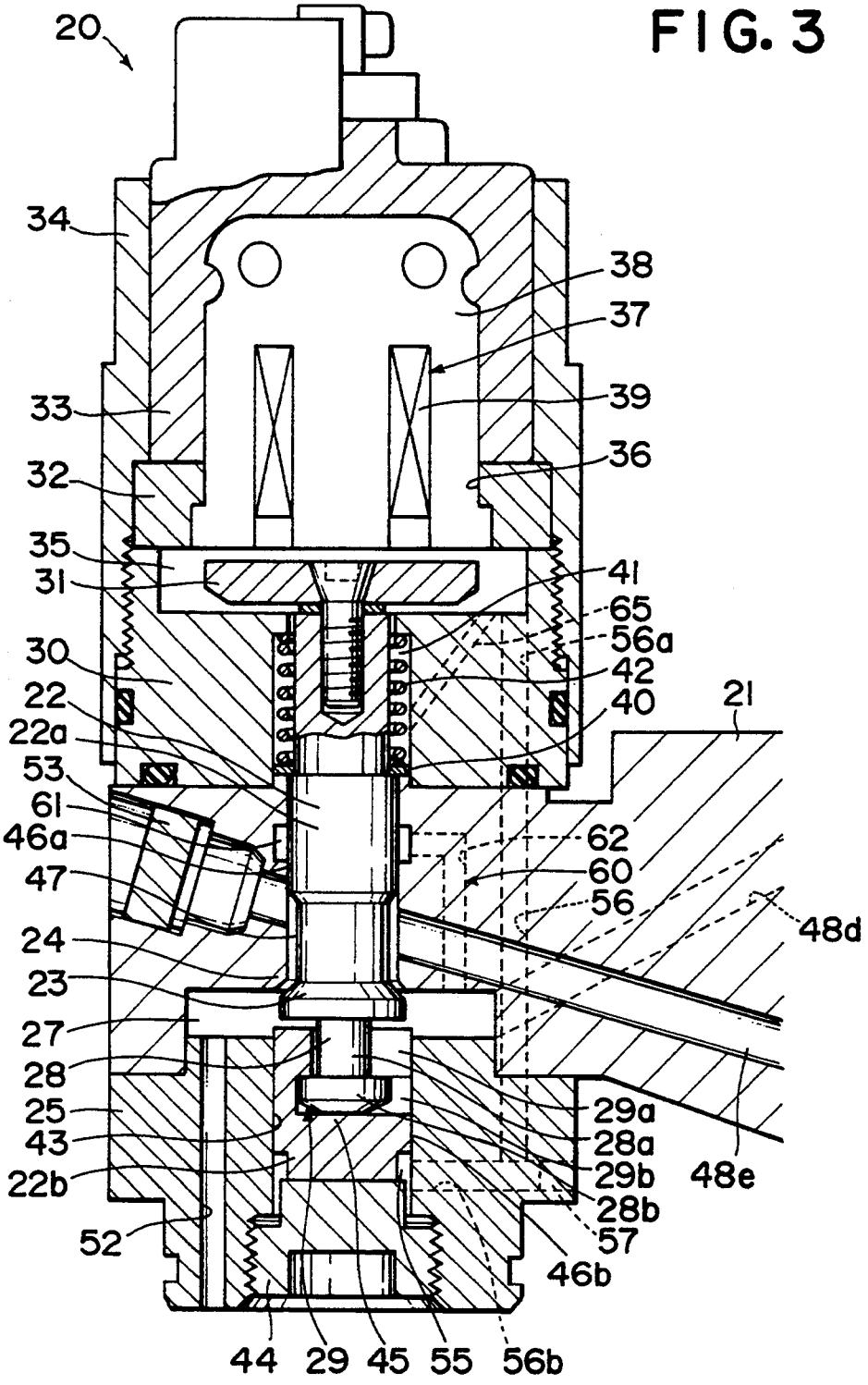
FIG. 3 shows an expanded sectional view of another example of a solenoid valve.
Figure 4:
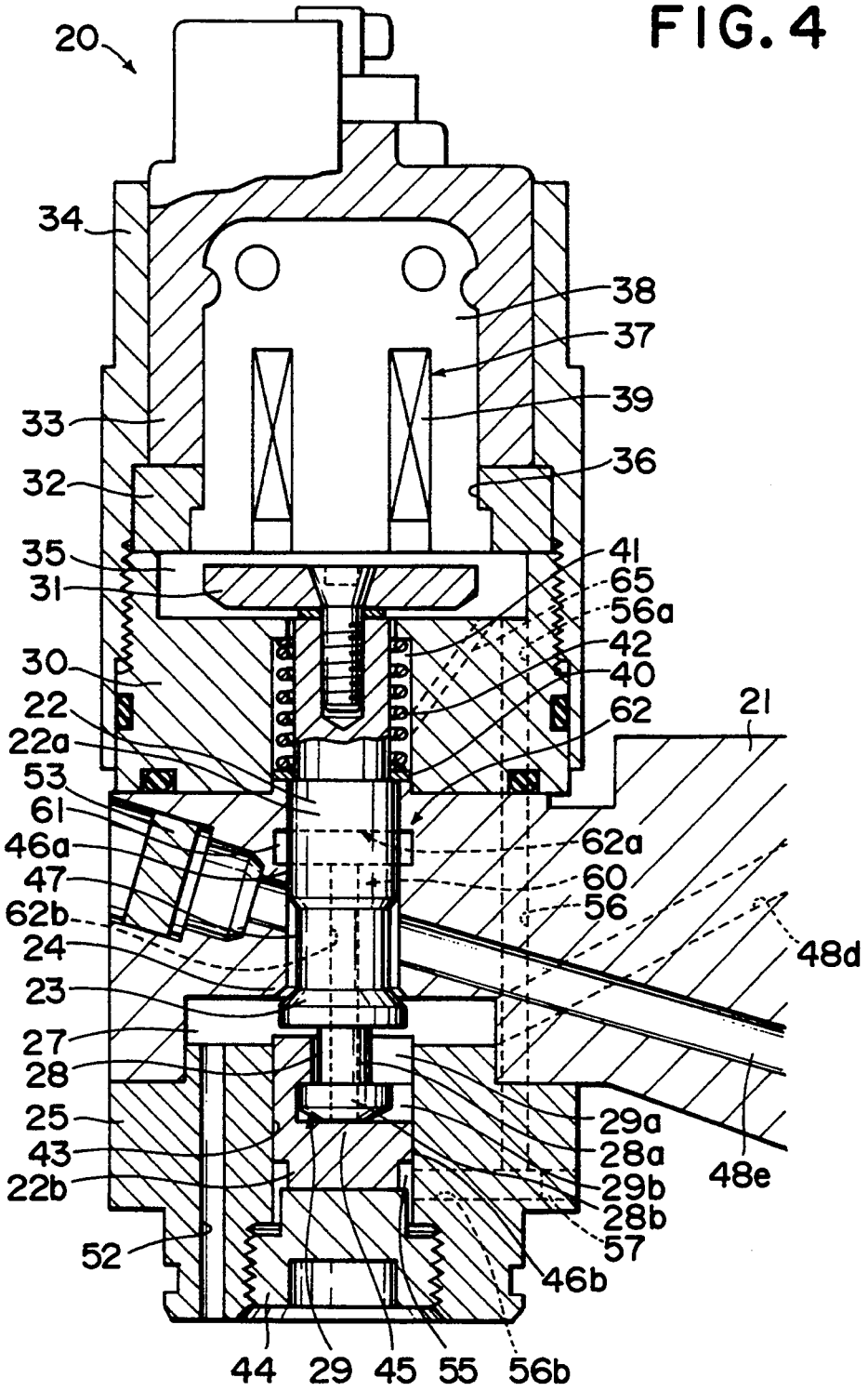
FIG. 4 shows an expanded sectional view of yet another example of a solenoid valve.

FIG. 3 and FIG. 4 show other preferred examples of the present invention, which will be described below. For components identical to those in the aforementioned example, the same reference number is assigned, and the explanation thereof is omitted below. Explanation is given only for aspects which differ from the above example.

In solenoid valve 20, a release passage 60 is formed at some point along the sliding unit **46*a* between spill chamber 27 and armature chamber 35, to release the excessive high-pressure fuel that tries to leak through the sliding gap from the high-pressure side, and this release passage 60 constitutes the pressure-rise prevention passage. Various structures can be conceivable for the release passage 60. In the example in FIG. 3, the release passage comprises a loop-shaped groove 61 formed like a loop-shaped channel and formed in the area facing the sliding unit 45*a* of valve housing 21, and a leakage hole 62 connecting this loop-shaped groove 61 to spill chamber 27. In FIG. 4, the aforementioned leakage hole 62 is formed in valve body 22. Leakage hole 62 comprises a horizontal (or transverse) through-hole 62*a* formed in a transverse direction of first valve member 22*a* and opening into the aforementioned loop-shaped groove 61; vertical (or longitudinal) through-hole 62*b*, one end of which opens into horizontal through-hole 62*a* and other end of which opens into joining cavity 29 connecting the end of first valve member 22*a* and second valve member 22*b*. The loop-shaped groove 61 and spill chamber 27** are likewise connected.

By this structure, the leakage of excessive high-pressure fuel from the high-pressure side to armature chamber 35 is prevented, and the rise of pressure in armature chamber 35 can be prevented. Therefore, the structure wherein the clearance of sliding unit **56*b* is made larger than that of sliding unit 46*a* is not necessary, as with the case in the aforementioned example. For example, if valve 2 is, unlike the present example, composed of one valve member, and if vertical through-hole 62*b* is structured so as to open into balance chamber 55, the aforementioned structure, wherein the clearance of sliding unit 46*b* between spill chamber 27 and balance chamber 55** would be necessary.

As mentioned above, because equal pressure is exerted on both ends of the valve body of the solenoid valve by means of the connecting passage, and because the armature chamber and the balance chamber are separated by the sliding unit form the spill chamber accommodating the valve head formed in the middle of the valve, the pressure waves, caused by the high-pressure fuel spilled form the low-pressure chamber to the high-pressure chamber, are not transferred to the armature chamber. Therefore, the corrosion and deformation, which may occur after some period of time, can be reduced. In addition, a pressure-rise prevention passage is formed in the solenoid valve, and low pressure can be maintained in the armature chamber.

To attach header 25 to valve housing 21 of the solenoid valve, for example, a screw is used, but unless precision is very high in attaching header 25, a gap will be created between the center lines of sliding holes 19, 43 (i.e. the holes will not be properly aligned). If the gap is within the range of clearance of sliding units 46a, 46b, it will not cause a problem, but if the gap caused by an attaching error exceeds the amount of the clearance, excessive friction will be generated in sliding units 46a and 46b, possibly undercutting the smooth movement of valve 22. In the present invention, however, valve 22 comprises two valve body members, first valve member 22a and second valve member 22b, and first valve member 22a and second valve member 22b can be shifted in direction relative to each other (i.e. radial play is left between valve members 22a and 22b). Therefore, the misalignment of the holes can be absorbed by valve body 22 without improving the precision level in attaching header 25, and there will not be a problem in the movement of valve 22.

Figure 5:
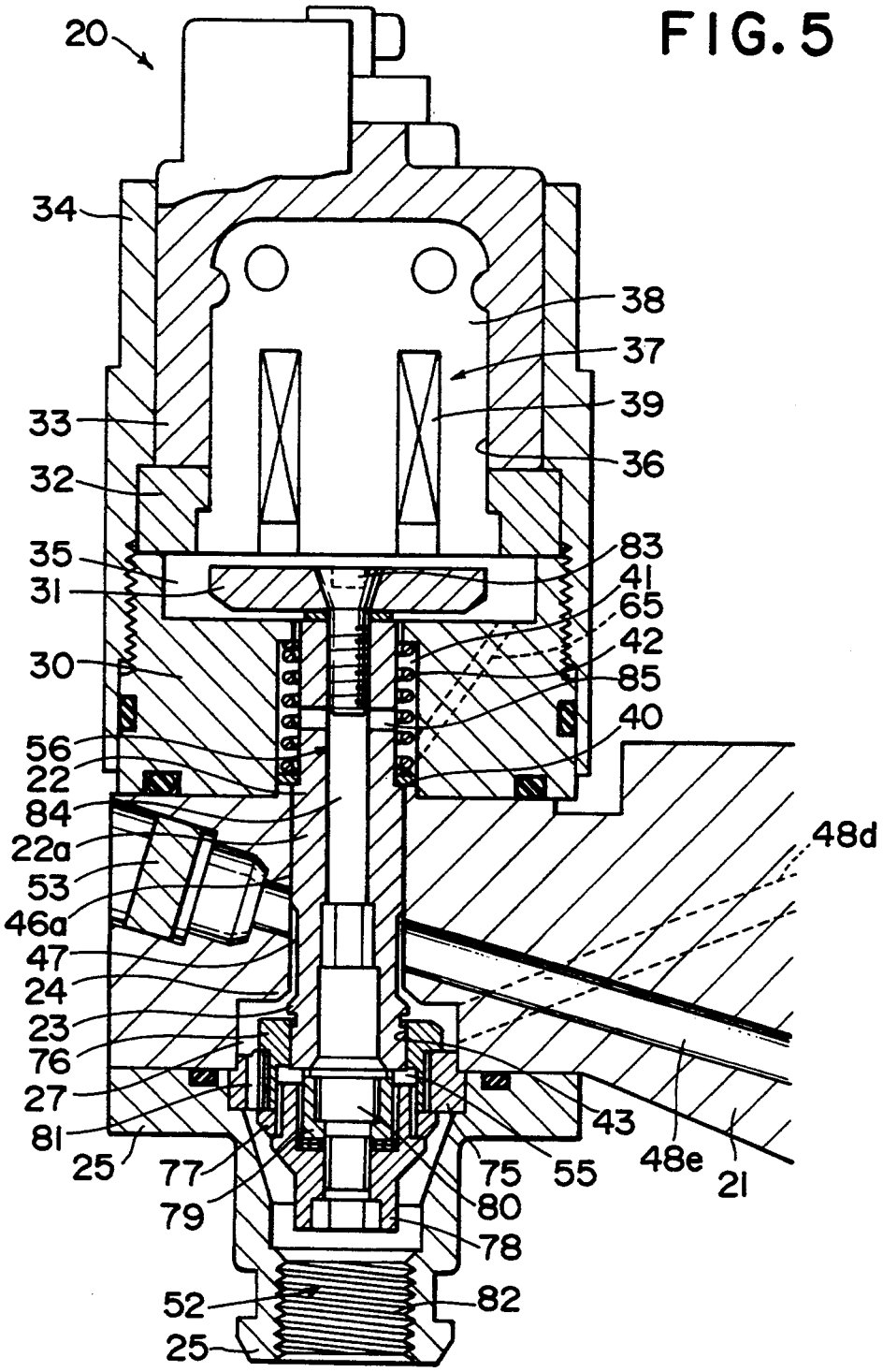
FIG. 5 shows an expanded sectional view of still another example of a solenoid valve.
Figure 6:
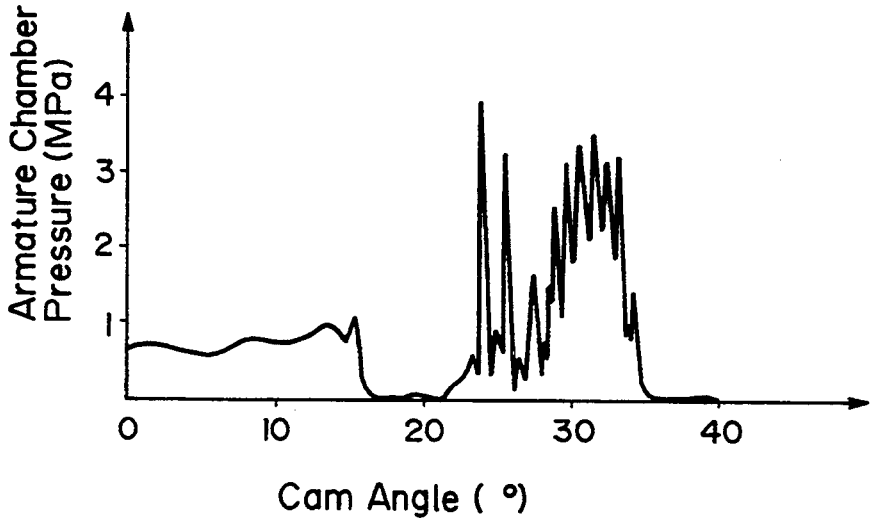
FIG. 6 shows test data illustrating changes in pressure in the armature chamber of the solenoid valve.

FIG. 5 shows another preferred example of the present invention. As in the aforementioned examples, the same reference numbers are assigned to components identical to those in the aforementioned examples and the explanation thereof is omitted, except for aspects which differ from the previous examples.

In this example, valve 22 is composed of one member, and in this play structure (compensation mechanism), header 25 and valve housing 21 hold a spacer 75 facing spill chamber 25, and a valve body holder 76 is inserted in this spacer 75 so as to leave some radial play therebetween. In sliding hole 43 of this valve body holder 76, the tip end of valve body 22 is slidably inserted. The play amount between valve body holder 76 and spacer 75 is determined, for example, by making the inner diameter of spacer 75 0.4–0.5 mm larger than the outer diameter of the insertion unit of valve body holder 76. The movement of this valve body holder 76 is restricted by screw member 78 that screws to ring-formed member 77. To screwing member 78, stopper 79 facing the end of valve body 22 is secured with bolt 80, and by adjusting the screwing level of bolt 80, the position of stopper 79 can be adjusted in relation to that of screwing member 78 in the axial direction.

In addition, a fuel outlet passage 52 is composed of multiple through-holes 81 formed in the edge of spacer 75, and an opening 82 formed in the center of the header and connected to through-hole 81.

In the aforementioned valve body 22 of solenoid valve 20, a vertical (or axial) hole 84 is formed, in the one end having valve head 23 through the other end connected to armature 31. This vertical hole 84 has, on its armature side, a screw hole to secure valve 22 to armature 31, and the hole is closed with screw 83 screwed in the center of armature 31.

In front of screw 83 of this vertical hole 84, horizontal (or axial) hole 85 opens into spring case 41, and spring case 41 is connected to armature chamber 35 by connecting passage 65. Accordingly, a connecting passage 56 is constituted by connecting passage 65, vertical (axial) hole 84, horizontal (transverse) hole 85, and spring case 41. Balance chamber 55, which is surrounded by valve body 22, valve body holder 76, screwing member 78, and stopper 79, is connected to armature chamber 35 via connecting passage 56.

The clearance of sliding unit 46a between spill chamber 27 and armature 35 is set smaller than that of sliding unit 46b between spill chamber 27 and balance chamber 55, as with the case in the aforementioned example, so the increase in pressure in armature chamber 35 is prevented.

In this arrangement, even if the gap is created in the Longitudinal direction in mounting the header, the gap is absorbed by the play mechanism between valve body holder 76 and spacer 75.

In the aforementioned example, an instance in which fuel injection pump 1 and unit injector are used is discussed, but this type of control in the present invention is applicable to any type of fuel injection pump, for example, to a distribution type or in-line type.

As explained above, because a play mechanism is formed between each of the members in which the valve of the solenoid valve slides, to absorb a gap between the sliding holes in members, the smooth movement of the valve body can be secured, without improving the precision in assembling every valve member. The present invention offers an advantage that since higher precision in assembly is not required, more simplified operation is possible, and the labor necessary is reduced.

It goes without saying that various revisions and modification of the aforementioned technology are possible. Therefore, the present invention can be possibly implemented in some other variant forms not mentioned in the claims. However, all the variations that remain within the scope of the essential idea of the present invention are encompassed by the claims.

What is claimed is:

1. A fuel injection control device comprising:

an injection nozzle;

a compressor fluidically coupled with said injection nozzle and comprising a plunger barrel, a cylinder formed in said plunger barrel, and a plunger reciprocatingly disposed in said cylinder;

a fuel supply passage fluidically connecting said compressor with a fuel intake; and a solenoid valve operably coupled in said fuel supply passage and dividing said fuel supply passage into a fuel intake side and a compressor side;

wherein said solenoid valve comprises a valve housing including a valve seat, a valve body including a valve head and being movably mounted in said valve housing for movement between a closed position in which said valve head is seated in said valve seat, and an open position in which said valve head is spaced from said valve seat, said valve head being accommodated in a spill chamber fluidically connected to the fuel intake side of said fuel supply passage, an armature connected to a first end of said valve body, said armature being accommodated in an armature chamber, a solenoid for moving said armature to move said valve body toward said closed position, a return spring connected to said valve body and urging said valve body toward said open position, a balance chamber formed about a second end of said valve body, a connection passage fluidically connecting said balance chamber to said armature chamber, and a pressure-rise prevention passage fluidically connected to said armature chamber to prevent a rise in pressure therein.

2. A fuel injection control device as recited in claim 1, wherein said solenoid valve further comprises a header attached to said valve housing so as to cover said valve head and such that said spill chamber is formed between said header and said valve housing, wherein a valve body insertion hole is formed through said header and said valve housing, and said valve body is slidably mounted in said valve body insertion hole, wherein an adjusting plug is mounted in said header to close one end of said insertion hole, wherein said balance chamber is defined between said valve housing, said header and said adjusting plug, wherein a first sliding unit is constituted by confronting sliding surfaces of said valve body and said insertion hole, respectively, between said spill chamber and said armature chamber, said confronting sliding surfaces of said first sliding unit being spaced apart by a first clearance, wherein a second sliding unit is constituted by confronting sliding surfaces of said valve body and said insertion hole, respectively, between said spill chamber and said balance chamber, said confronting sliding surfaces of said second sliding unit being spaced apart by a second clearance, wherein said first clearance is smaller than said second clearance, and wherein said second clearance constitutes said pressure-rise prevention passage.

3. A fuel injection control device as recited in claim 2, wherein said connection passage comprises a first hole formed through said valve housing and said header along a direction in which said valve body is adapted to be moved, and a second hole formed through said header from an outer surface thereof through an inner surface thereof to open into said balance chamber, said second hole intersecting with said first hole in said header, and a blind plug is mounted in said second hole at said outer surface of said header to close one end of said second hole.

4. A fuel injection control device as recited in claim 1, wherein said solenoid is operable, upon being electrically actuated, to move said valve body to said closed position to cut off communication between said intake side and said compressor side of said fuel supply passage, and, upon being electrically deactivated, to allow said valve body to be moved to said open position by said return spring to allow communication between said intake side and said compressor side of said fuel supply passage.

5. A fuel injection control device as recited in claim 1, wherein a valve body insertion hole is formed through said valve housing, and said valve body is slidably mounted in said valve body insertion hole, wherein a first sliding unit is constituted by confronting sliding surfaces of said valve body and said insertion hole, respectively, between said spill chamber and said armature chamber, said confronting sliding surfaces of said first sliding unit being spaced apart by a first clearance, and wherein said pressure-rise prevention passage comprises a release passage fluidically connected between said first clearance and said spill chamber.

6. A fuel injection control device as recited in claim 5, wherein said release passage comprises an annular groove formed in said valve housing about said insertion hole at said first sliding unit, and a passage formed in said valve housing between said annular groove and said spill chamber.

7. A fuel injection control device as recited in claim 5, wherein said release passage comprises an annular groove formed in said valve housing about said insertion hole at said first sliding unit, and a passage formed through said valve body and connecting said annular groove and said spill chamber.

8. A fuel injection control device comprising:

an injection nozzle;

a compressor fluidically coupled with said injection nozzle and comprising a plunger barrel, a cylinder formed in said plunger barrel, and a plunger reciprocatingly disposed in said cylinder;

a fuel supply passage fluidically connecting said compressor with a fuel intake; and a solenoid valve operably coupled in said fuel supply passage and dividing said fuel supply passage into a fuel intake side and a compressor side;

wherein said solenoid valve comprises a valve body, first and second valve body accommodating members respectively having first and second valve body insertion holes formed therethrough, said first and second valve body accommodating members being mounted to one another such that said first and second valve body insertion holes are approximately aligned, a valve seat being formed in one of said first and second valve body accommodating members at a junction between said first and second valve body accommodating members, said valve body being slidably disposed in said first and second valve body insertion holes, an armature secured to said valve body, a solenoid for attracting said armature to cause said valve body to slide in a first direction in said first and second valve body insertion holes, a return spring mounted to one of said first and second valve body accommodating members and urging said valve body to slide in a second direction opposite said first direction, and a compensation mechanism provided adjacent the junction between said first and second valve body accommodating members for compensating for misalignment of said first valve body insertion hole relative to said second valve body insertion hole.

9. A fuel injection control device as recited in claim 8, wherein said first valve body accommodating member comprises a valve housing, and said valve housing has said valve seat formed therein, said valve body comprises a first valve body member slidably mounted in said valve housing, and a second valve body member connected to an end of said first valve body member, said first valve body member having a valve head formed thereon and seatable in said valve seat, said second valve body accommodating member comprises a header mounted to said valve housing to cover said valve seat, said second valve body member being slidably mounted in said header, wherein said compensation mechanism is constituted by the connection of said second valve body member to said first valve body member, said connection of said second valve body member to said first valve body member being such as to leave radial play between said first and second valve body members.

10. A fuel injection control device as recited in claim 8, wherein said first valve body accommodating member comprises a valve housing, and said valve housing has said valve seat formed therein, said valve body comprises a single valve body member slidably mounted in said valve housing and having a valve head formed thereon and seatable in said valve seat, said second valve body accommodating member comprises a header mounted to said valve housing to cover said valve seat and to form a spill chamber between said header and said valve housing, said valve head being accommodated in said spill chamber, and said compensation mechanism comprises a spacer held by said header and said valve housing so as to face said spill chamber, and a holder attached to said spacer in such a manner as to leave radial play between said spacer and said holder, said valve body being slidably mounted in said holder.

* * * * *